United States Patent [19]

Ackeret

[11] 4,150,591

[45] Apr. 24, 1979

[54] DEVICES FOR OPENING SCREW CAPS ON CONTAINERS

[75] Inventor: Peter Ackeret, Küsnacht, Switzerland

[73] Assignee: Zyliss Zysset AG, Lyss, Switzerland

[21] Appl. No.: 850,928

[22] Filed: Nov. 14, 1977

[30] Foreign Application Priority Data

Dec. 21, 1976 [DE] Fed. Rep. of Germany ..... 2657887
Jul. 16, 1977 [DE] Fed. Rep. of Germany ..... 2732203

[51] Int. Cl.[2] ..... B67B 7/00; B25B 13/52

[52] U.S. Cl. ..... 81/3.43; 81/65; 24/20 LS

[58] Field of Search ..... 81/3.43, 64, 65, 157, 81/161; 24/19, 20 R, 20 LS

[56] References Cited

U.S. PATENT DOCUMENTS

| | | | |
|---|---|---|---|
| 1,147,625 | 7/1915 | Eikelberger | 81/3.43 UX |
| 1,452,468 | 4/1923 | Lee | 81/3.43 UX |
| 3,133,463 | 5/1964 | Davis | 81/65 |
| 3,851,548 | 12/1974 | Rutz | 81/3.43 |

*Primary Examiner*—James L. Jones, Jr.
*Assistant Examiner*—James G. Smith
*Attorney, Agent, or Firm*—H. Dale Palmatier

[57] ABSTRACT

A tool for turning the screw cap on a container and having a handle and a band to loop around the screw cap, a screw-threaded tensioning device to tighten the band onto the screw cap, and a quick release nut or other similar quickly releasing device to quickly release the band.

14 Claims, 20 Drawing Figures

Fig. 1
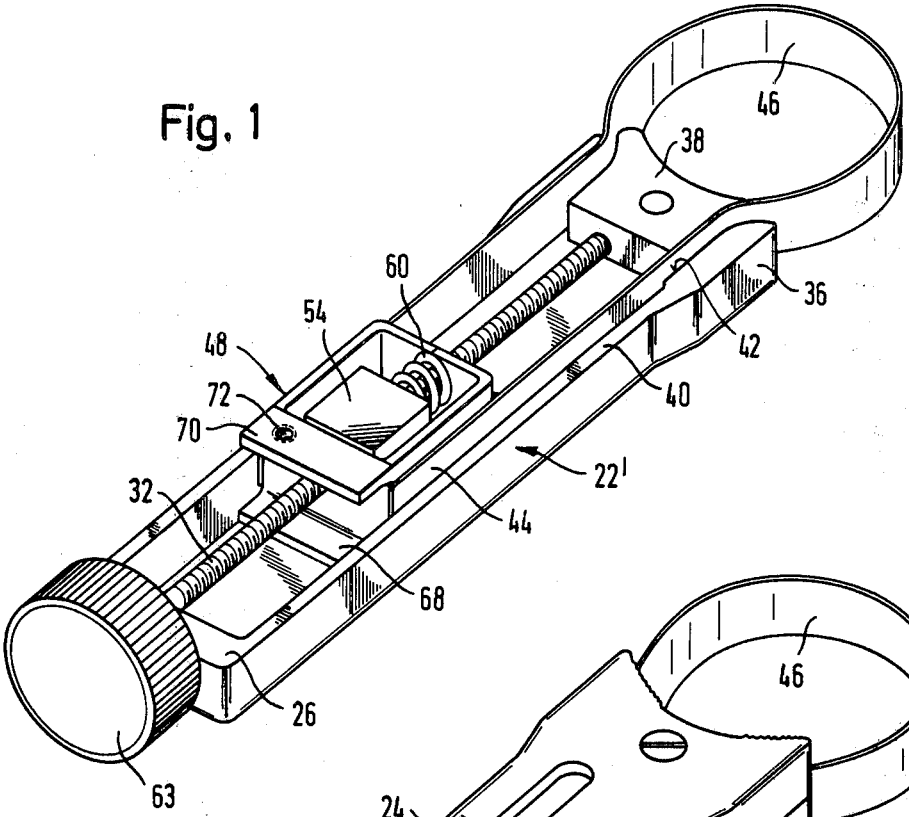
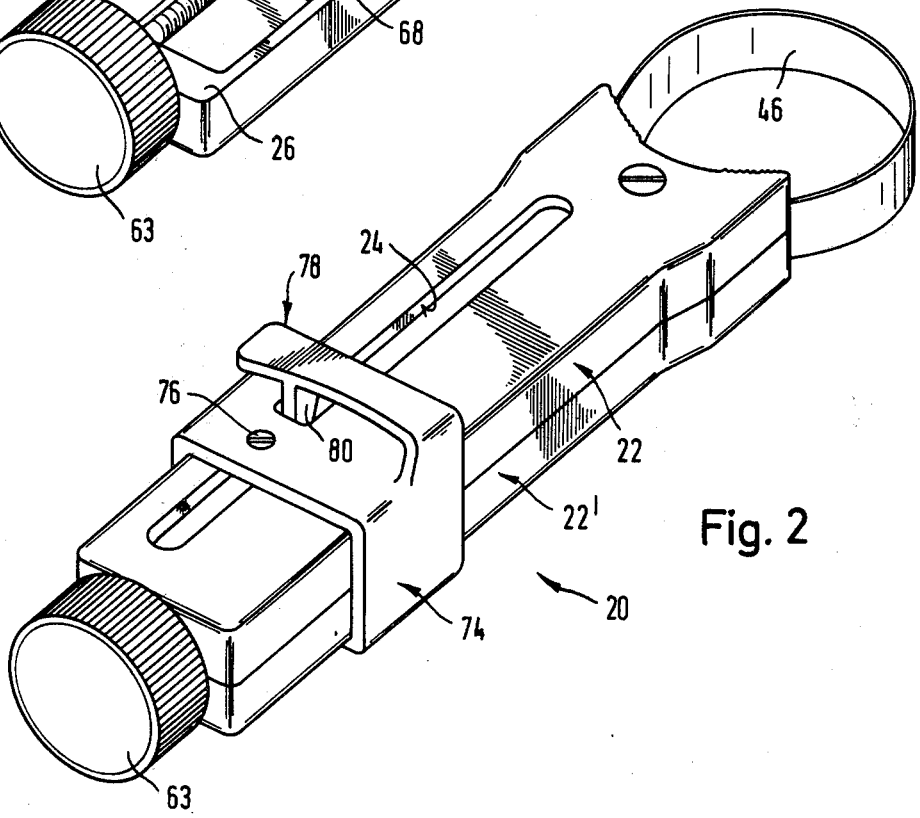
Fig. 2

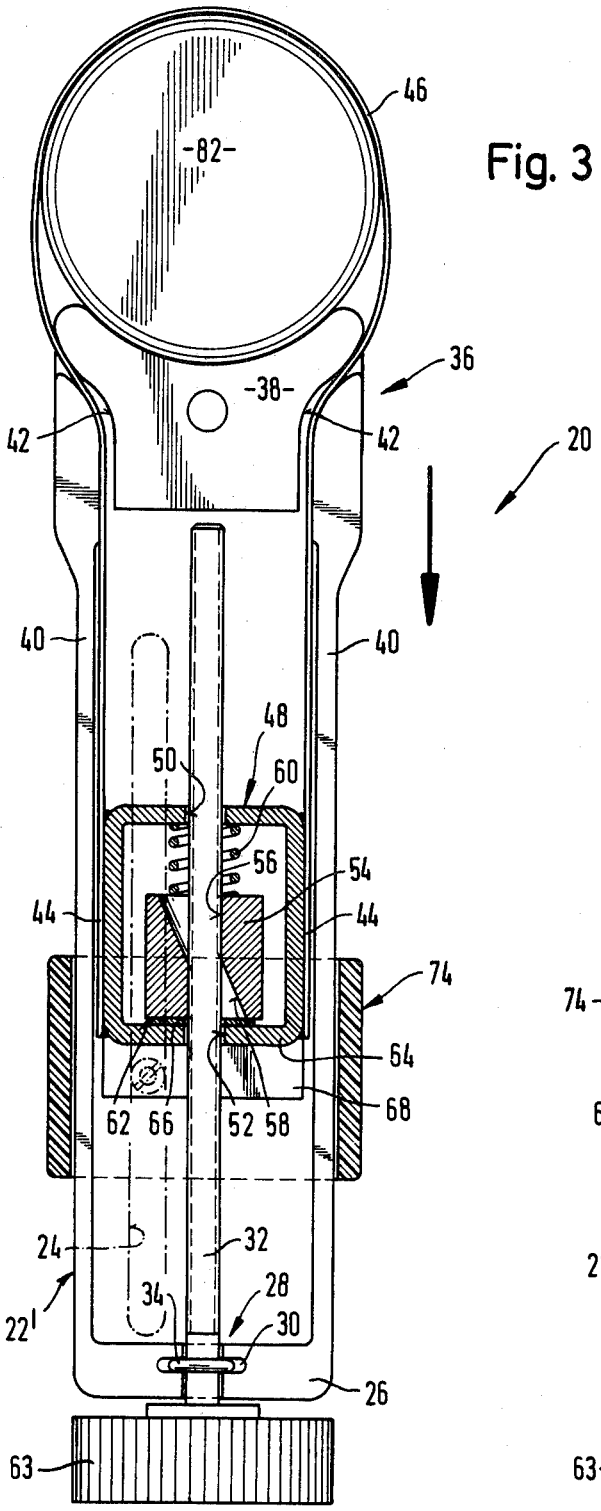
Fig. 3
Fig. 4
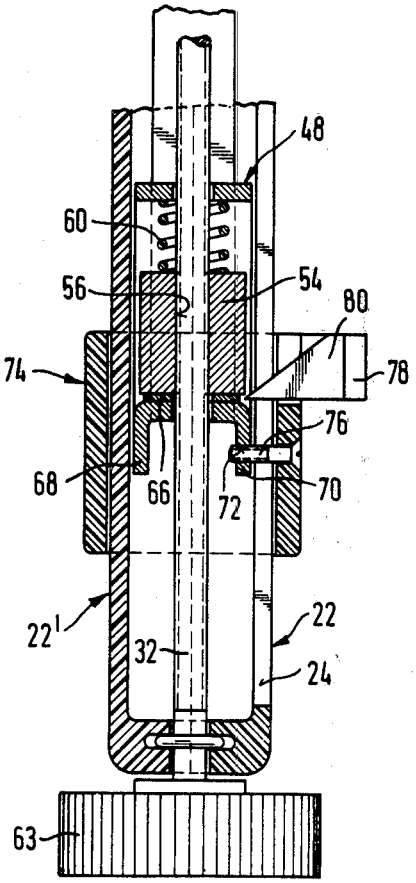

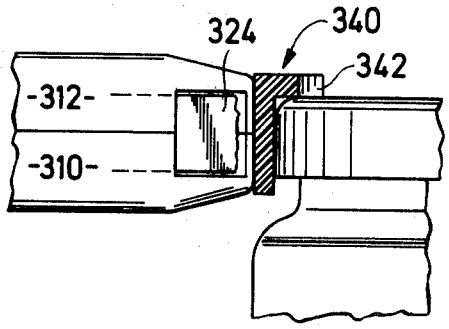
Fig. 18
Fig. 19
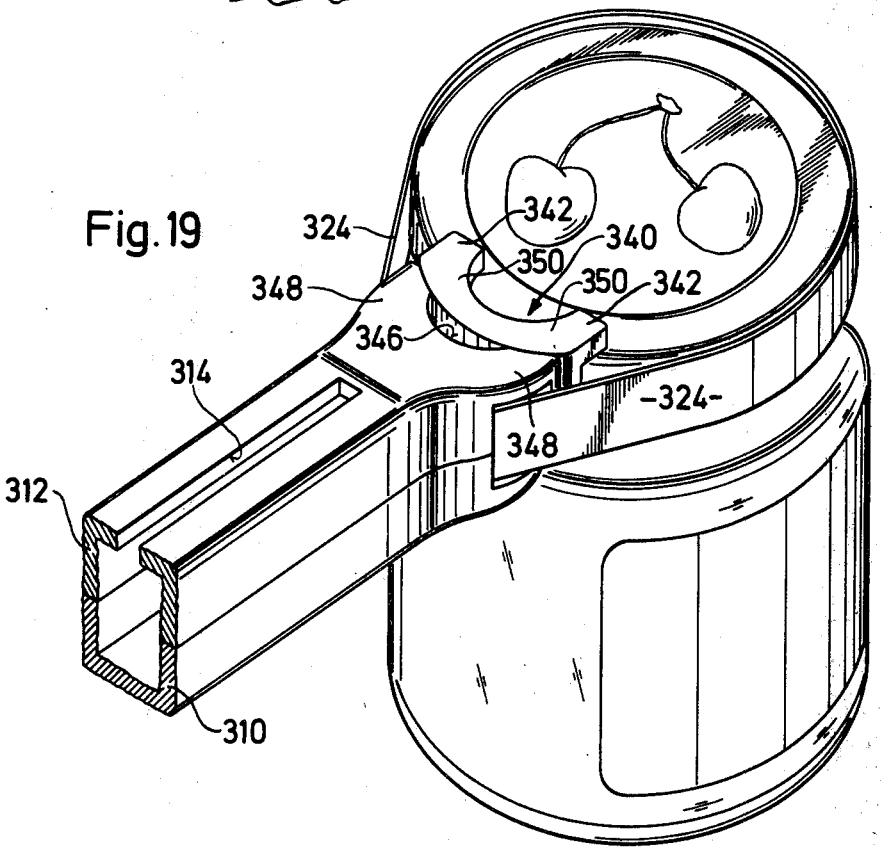
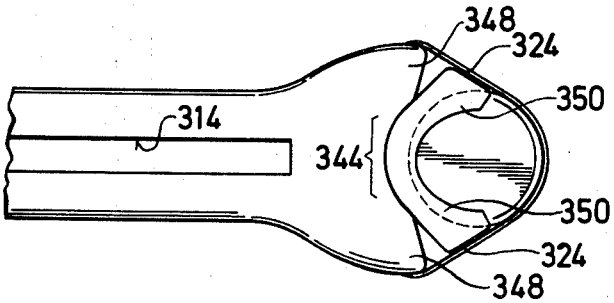
Fig. 20

DEVICES FOR OPENING SCREW CAPS ON CONTAINERS

This invention relates to devices for opening screw caps on containers.

Swiss Patent Specification No. 508,550 describes a manually-operated device for opening a screw-capped container. This known device is available commercially and comprises a handle mounting a band of material to be placed about the screw cap to be opened. The handle contains an axially-fixed threaded rod rotatable by hand and carrying a threaded nut to which at least one end of the band is secured. The nut is free to move axially but not to rotate, so that rotation of the rod in one direction enables the band to be drawn into the handle and tightened or tensioned about the screw cap.

The known device has a plastics handle, from one end of which the tensioning band projects in a loop, whilst at the other end there is situated a knob for turning the threaded rod. The ends of the tensioning band, which can be made of steel for example, are welded onto the nut which likewise can be made of steel. When the knob is turned, the nut moves along the threaded rod, the nut being prevented from turning in the handle, so that the loop of the tensioning band is retracted into the handle or is expelled from it according to the direction in which the knob is turned. To cause the loop to assume an approximately round shape, the handle has correspondingly curved guide grooves for the ends of the tensioning band. When the loop is placed around a screw cap and tightened then the cap can be easily opened using the handle as a lever, since the loop does not distort the cap.

The functioning of the known device cannot be faulted in this respect. In practice, however, it proves to be a disadvantage that the adjustment of the size of the hoop and the tightening of the hoop are effected using one and the same mechanism. This does in fact have the result that a compromise, which is not absolutely favourable, has to be made for the thread pitch of the rod, occasioned on the one hand by the demand for a higher clamping force (which presupposes a small thread pitch) and on the other hand by the requirement that the adjustment of the size of the loop can be effected within a reasonable time, which necessitates a thread of a coarse pitch. The thread pitch of the commercial device is comparatively small, so that it takes a correspondingly long time to adjust the size of the loop to the size of a screw cap. An unpractised user will not even be able to see immediately whether he is enlarging or tightening the loop when turning the knob.

Such an adjustment is, however, necessary practically every time the device is used, for the user will generally put away the device so that it occupies as little space as possible (that is, with the loop completely retracted), whereas the chief application is the opening of container caps of large diameter which are most difficult to open without assistance.

Each of the embodiments of the invention shown in the attached drawings comprises a manually operated device for opening a screw cap of a container using a tensioning hoop, the ends of which are guided in a handle, and which can be tightened towards the handle by means of a threaded spindle which can be rotated by hand inside the handle but which is axially fixed, and by means of a nut which is joined to at least one end of the tensioning band, and is fixed so that it cannot rotate in the handle but can move axially, characterised in that at least one end of the tensioning band is in operative connection with a sliding grip which may be displaced axially relative to the threaded spindle, by means of which sliding grip the nut designed as a quick-action nut can be disengaged from the spindle thread and moved, together with the end of the band, by the sliding grip along the spindle, that the nut can engage in any relative position of the sliding grip and that the end of the tensioning band with the nut is reliably joined to the coupling engagement when a pull is exerted.

The embodiments are simple to use even by persons unfamiliar with them and have very good clamping and adjustment characteristics because clamping and gross adjustment of size are made independent of each other. It will be seen that by means of the sliding grip, the end or ends of the tensioning band may be displaced by a simple sliding movement, so that the hoop can first of all be opened fully and then placed around the screw cap and tightened. The nut then engages again (which can be effected by hand or automatically) and the hoop is tightened by turning the spindle. The hoop can be loosened by pushing the sliding grip or, alternatively, by unscrewing the spindle.

The term "quick-action nut" used above includes a series of special nuts which are so constructed that they can be detached from their associated thread and coupled up to it again, but in their detached state can be moved along the thread. For this purpose the nut may have at an angle to its threaded bore a continuous hole intersecting the latter and having a diameter matched to the outer diameter of the threads of the bolt; when the nut is appropriately tilted then the threads disengage. Alternatively, a nut divided along its length can be used and the parts radially expanded for displacement.

By way of example only, certain illustrative embodiments of the invention will now be described with reference to the accompanying drawings, in which:

FIG. 1 shows a perspective view of a first device embodying the invention, certain parts of the device being omitted for clarity;

FIG. 2 illustrates the device shown in FIG. 1 when in a closed position;

FIG. 3 is an axial section through the device illustrated in use clamped on a screw top;

FIG. 4 is a partial section, perpendicular to the section shown in FIG. 3;

Figure 15:
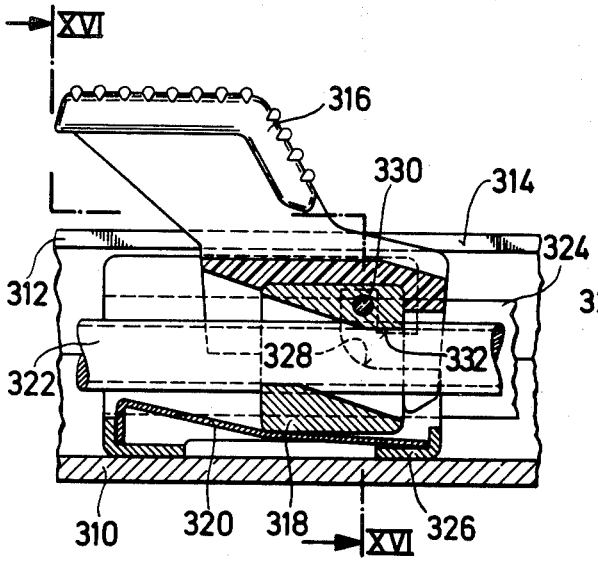
FIG. 15 shows a partially cut away side view of a fourth embodiment in cross-section along line XV—XV of FIG. 16.
Figure 17:
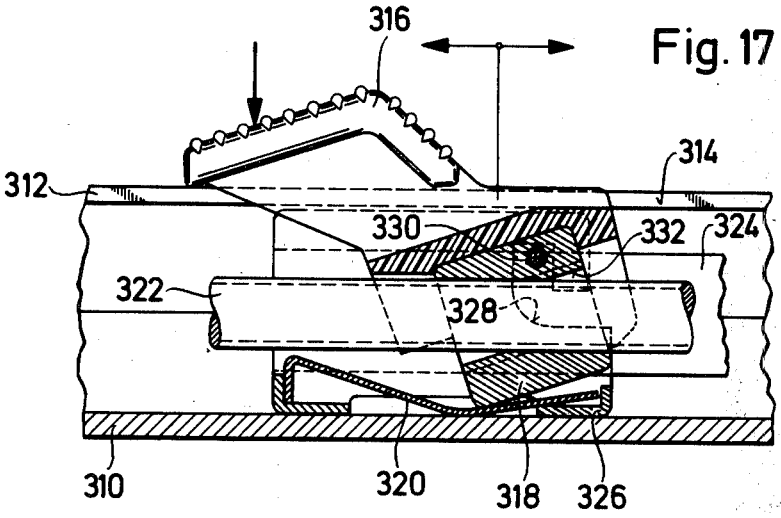

FIG. 17 corresponds to FIG. 15 with the nut disengaged;

FIG. 18 is a partially cut away side view, with the tensioning band broken away, of the end of the device positioned nearest the container;

FIG. 19 shows a partial perspective view of the device, in use; and

FIG. 20 is a schematic plan view of the end of the device nearest the container when opening a very small closure.

A first embodiment of the invention is illustrated in FIGS. 1 to 7. Referring to these Figures a device for opening a screwcapped container has an elongate handle 20 consisting of two haft members 22 and 22' which are almost mirror images of each other. Haft member 22 differs from haft member 22' only in that the former has a slot 24 extending parallel to its longitudinal axis which the latter does not. At one end 26 a respective half of a bearing portion 28 with a peripheral groove 30 of enlarged diameter is machined into each haft part. A threaded rod 32 is rotatably mounted in this bearing portion and has a collar 34 located in the groove 30 so that its axial position relative to the handle 20 is fixed.

The handle 20 over the greater part of its length is hollow and of rectangular section (FIG. 7) but at its other end 36 has a guide block 38. Between this and sides 40 of the haft members 22 and 22', which sides have a greater thickness in this region, two guide passages 42 are located, through which ends 44 of a tensioning band 46 pass into the interior of the handle.

These passages serve to bend the tensioning band, which when outside the handle forms a closed loop, so that the loop is as far as possible of a circular shape. For this reason the flat sides of the tensioning band, which is a steel band, rest against the sides of the passage such that the friction is comparatively great and the displacement of the band requires a certain expenditure of force.

The ends 44 of the tensioning band are rigidly fastened to a retainer 48, preferably welded on. The retainer is a hollow member made of bent sheet metal having two axially-aligned bores 50 and 52 through which the rod 32 passes and in which it is free to rotate. Inside the retainer is a quick-action nut 54. The nut 54 is cuboid and has a threaded bore 56 extends centrosymmetrically along one main axis of the cube. A threadless bore 58 on the other hand extends at an angle through the body of the nut. The dimensions of the nut are selected such that it can tilt inside the retainer by an amount corresponding to the angle of the threadless bore 58 (see FIG. 5). A resilient restoring member comprising a helical spring 60 acts on the nut and urges the plane end face 62 of the nut towards an operating knob 63 mounted on the rod 32; the retainer 48 has a stop part 64 but the nut does not rest directly on it but rather on a cup spring 66 located on the rod so that it is free to move. Two angled tabs 68 and 70 are provided on the retainer 48 and extend perpendicularly to the sides 40, the tab facing the slot 24 having a bore 72.

On the outside of the handle 20 an adjustment member in the form of a ring 74 is slidably mounted. A pin 76, for example and as shown a screw, is situated on the ring and through the slot 24 engages in the bore 72 of the retainer 48. Furthermore, a release lever 78 is formed on the ring 74, the free end of which release lever carries a wedge member 80 passing through the slot 24, the tip of which wedge member is located beneath the slot between the nut 54 and the stop part 64.

The device described thus far operates as follows: In FIG. 3 the tensioning loop 46 has been placed around the screw cap 82 of a container. Turning the knob 63 moves the nut 54 by virtue of its threaded section towards the end 26 of the handle, and in so doing a strong pull is exerted on the ends 44 of the tensioning band. As the ends of the tensioning loop are not, as perhaps might otherwise be thought, fastened directly to the nut, but are fastened to the retainer and provide axially-directed reaction forces on the nut 54 through the intermediary of the stop part 64 the threads cannot disengage suddenly; instead; the engagement becomes more reliable the tighter the band is clamped about the screw cap.

If the loop is to be loosened, the knob 63 is turned in the opposite direction. As a result, first of all the cup spring 66 will relax, as it is considerably stronger than the helical spring 60. As the nut 54 moves, the adjusting member 74 is moved together with it, since the retainer 48 is firmly joined to the adjusting member by means of the pin 76.

Figure 5:
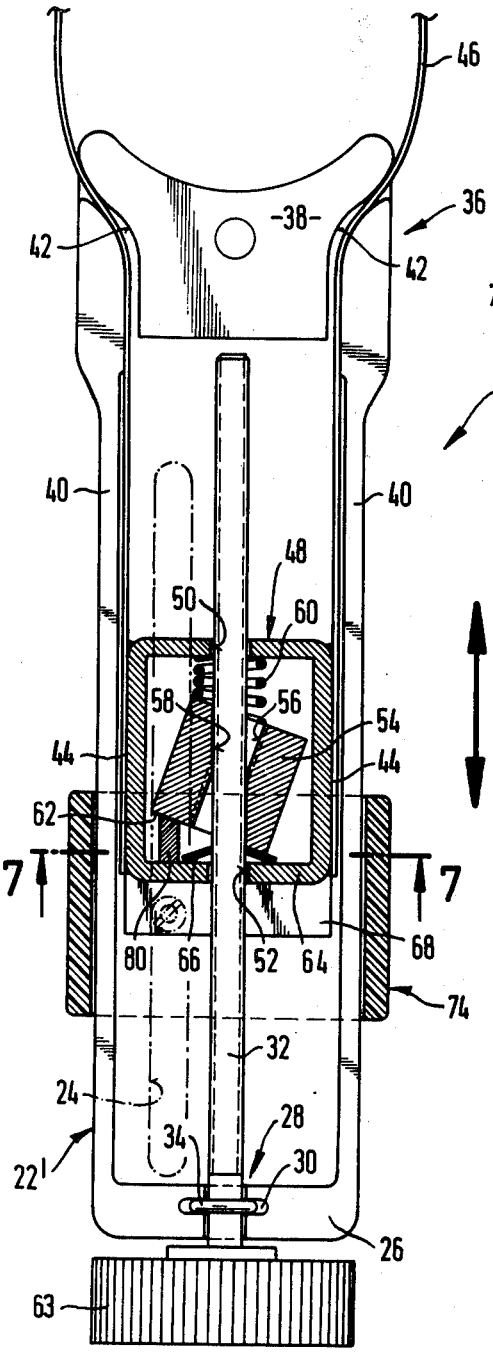
FIGS. 5 and 6 are sections analogous to FIGS. 3 and 4 but with the clamping device disengaged.
Figure 7:
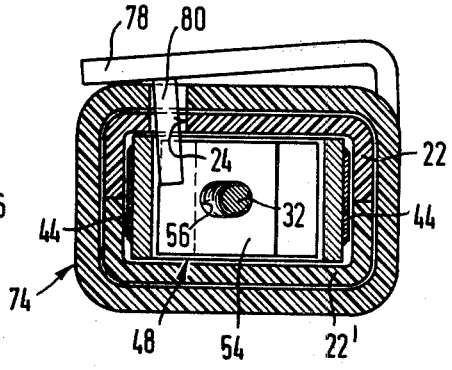
FIG. 7 is a cross-section along the line 7—7 of FIG. 5.
Figure 6:
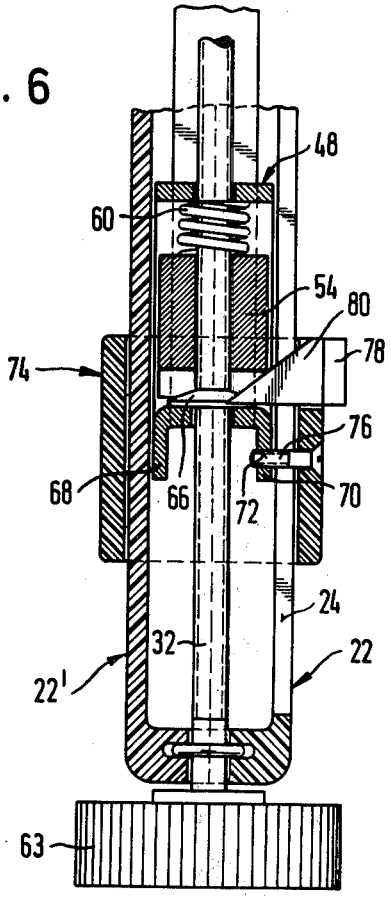
Figure 8:
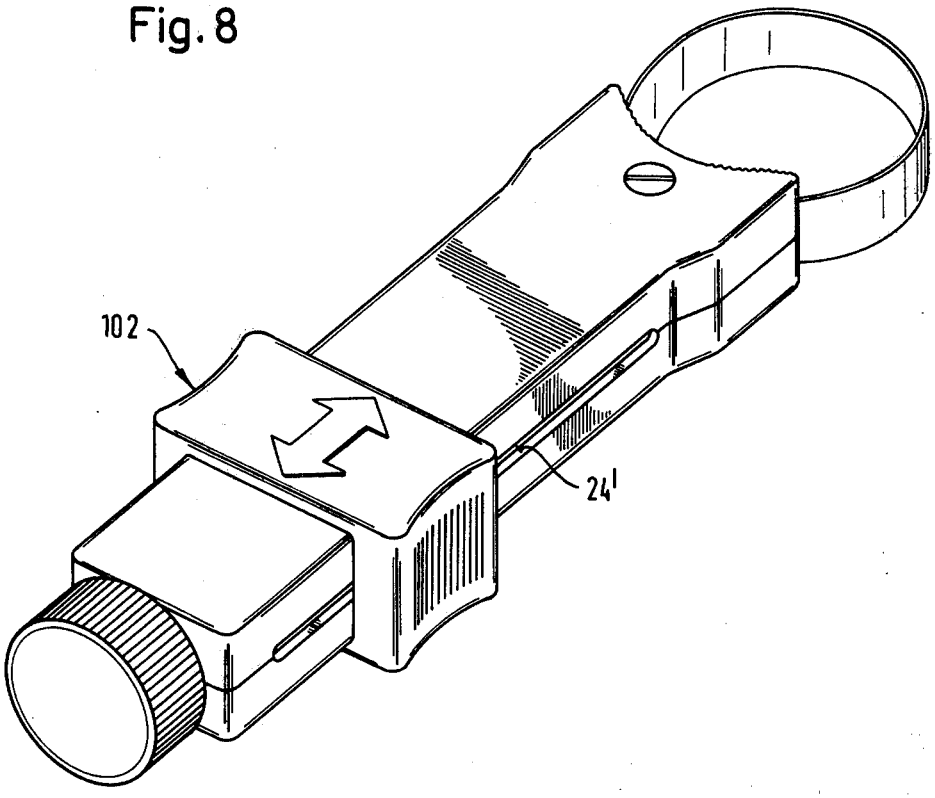
FIG. 8 is a perspective view of a second embodiment.
Figure 9:
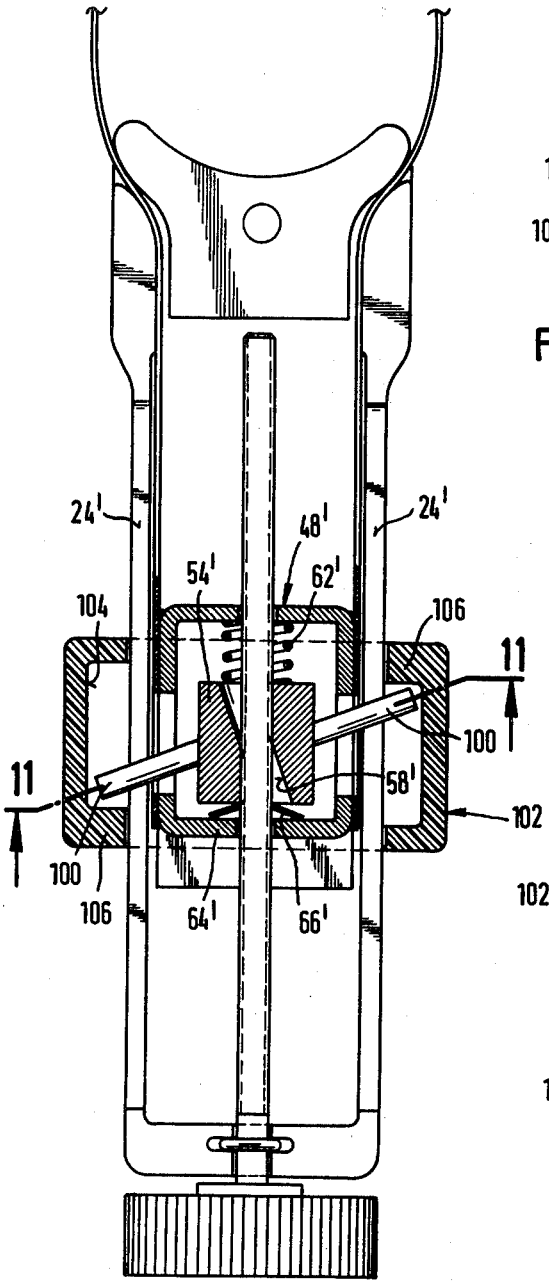
FIG. 9 is an axial section through the second embodiment when not in use.
Figure 11:
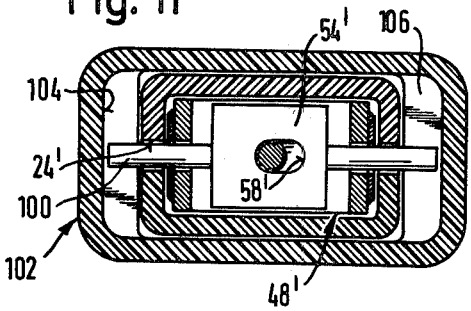
FIG. 11 is a cross-section along line 11—11 of FIG. 9.
Figure 10:
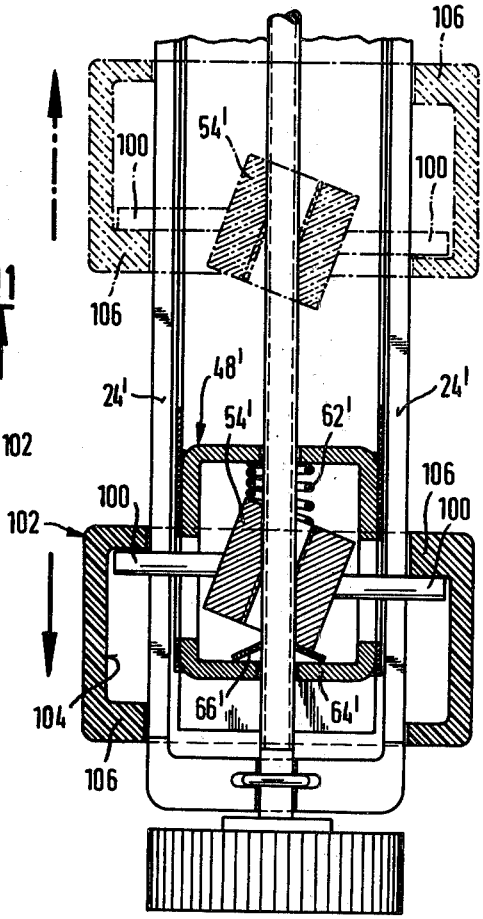
FIG. 10 is a section analogous to FIG. 9 in a rapid adjustment configuration.

For rapid adjustement, the user presses on the release lever 78. This does not engage directly transverse to the axis of the rod but on one side thereof (FIG. 7), and for this reason the nut 54 is raised by the cup spring 66, the cup spring ensuring that there is always a gap in which the wedge can engage. The nut is tilted so that its threads disengage the rod thread and so that it then has adjacent to the rod only the sides of its threadless bore 58. When the ring 74 is displaced, the retainer can therefore be taken with it until the loop has attained the desired size. The position of the individual parts relative to one another is illustrated in FIGS. 5 to 7 during the rapid adjustment procedure.

When the disengaging lever is released, the nut 54 returns under the bias of the spring 60 to its normal symmetrical position, so that the threads engage again.

A second embodiment of the invention is shown in FIGS. 8 to 11. Details corresponding to those of the first embodiment will not be described again in this or later embodiments. The difference between the first and second embodiments is the way disengagement is accomplished for rapid adjustment. On each side of a quick-action nut 54' there is a respective rocker arm 100, each rocker arm projecting towards the outside of the device through a respective slot 24'. The rocket arms 100 extend approximately perpendicularly to the threadless bore 58' of the nut, and are, as may be seen to greatest advantage in FIG. 10, staggered somewhat relative to one another. The adjusting member is a ring 102, arranged so that it can slide on the handle, having two cavities 104 facing respective ones of the slots 28' and the rocking arms 100. Each rocking arm projects into and is free to move in its associated cavity. Each cavity side 106 adjacent the end of a rocking arm is thicker than the mirror-wise opposite side of the other cavity.

This embodiment operates as follows:

Tightening and loosening of the tensioning loop are carried out as in the first embodiment. The ring 102 rests freely over the rocker arms 100, but when the nut 54' is moved is taken with the nut by these. If rapid adjustment is to be effected, then the handle is held firmly and the ring 102 is displaced relative thereto. In this step, depending on whether the ring is being displaced so that the loop is tightened or loosened, either one or other of the thicker parts of the cavity wall strikes against the relevant rocker arm and in so doing brings the nut 54' into the position shown in FIG. 10. Springs 62' and 66' subsequently bring the nut automatically into its engaged position again. It should be noted that the cup spring 66' is used in this case also to enable release when the loop is tightened, otherwise the nut would not be able to tilt because its plane face would rest tightly against the stop part 64' of the retainer 48'.

Figure 12:
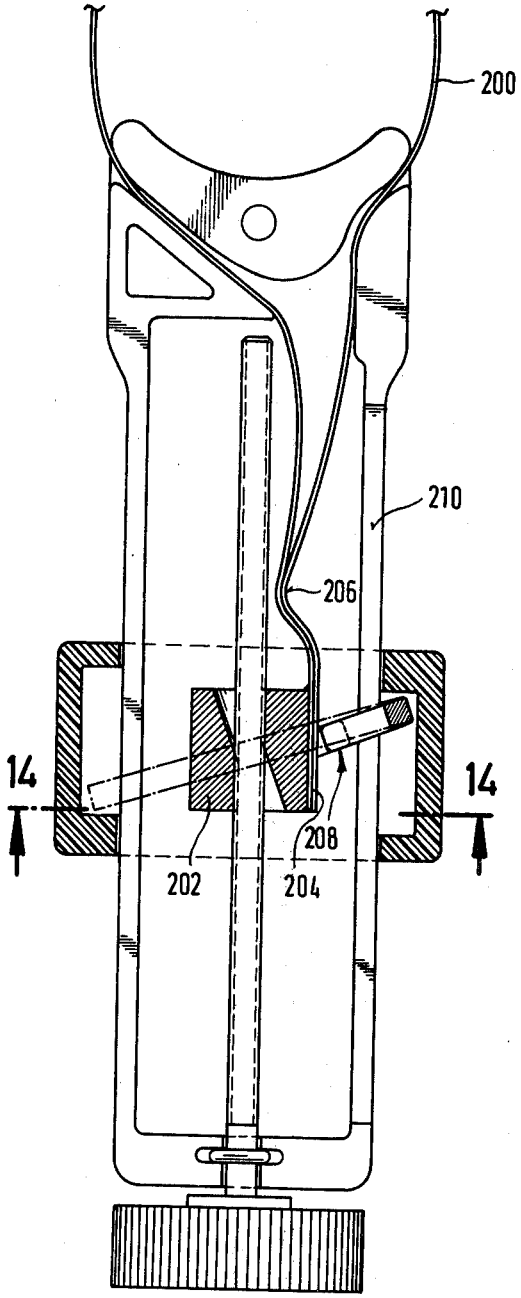
FIG. 12 is a longitudinal section, analogous to FIG. 9, of a third embodiment.
Figure 14:
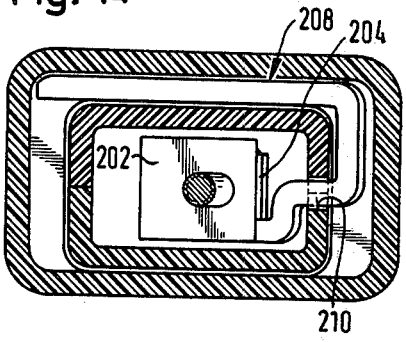
FIG. 14 shows a cross-section along the line 14—14 of FIG. 12.
Figure 13:
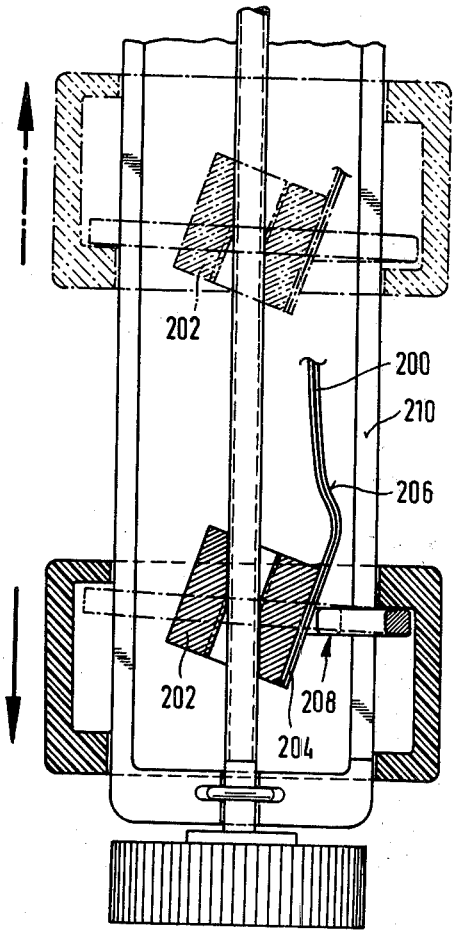
FIG. 13 is a longitudinal section through the third embodiment, analogous to FIG. 10.

A third embodiment of the invention is illustrated in FIGS. 12 to 14. Unlike the previously described embodiments, a tensioning band 200 is in this case connected directly to a quick-action nut 202, so a retainer is not, therefore, provided. Despite this, when subjected to stress the nut 202 is continually pressed into its engaged position because both ends 204 of the tensioning band are welded jointly to that side of the nut on which a corresponding moment is required to maintain the threaded parts in engagement. As it is desirable for the nut to engage automatically in any position, even when no pull is exerted, the tensioning band has a bend 206 near to the point at which it is joined to the nut. The tensioning band consists of a resilient material and this bend is so positioned that the desired moment is effective on the nut even when the tensioning loop is out of use.

The means for effecting rapid adjustment correspond in function to those of the second embodiment. However, as it is desirable that the handle should be weakened as little as possible, (every longitudinal slot is, of course, a weakening) in this case rocker arms are not positioned on both sides of the nut but only one rocker arm 208 is provided which passes through a slot 210 and then upwards and sideways forming an angle along the outside of the handle. Alternatively, a centrosymmetrical slot could be provided above the nut, through which a pin extends from the nut and on which pin the two rocker arms would then rest symmetrically.

It is not obligatory that the re-engagement of the quick-action nut is effected automatically under spring action; as an alternative, the adjusting member could be so designed that not only the disengagement, but the engagement as well is carried out manually.

Figure 16:
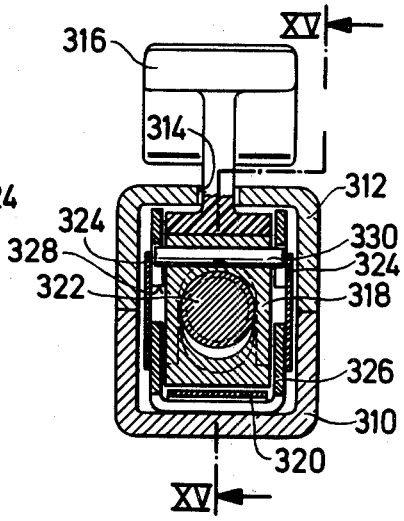
FIG. 16 is a rear view of the embodiment of FIG. 15, partially cut away, along the line XVI—XVI of the same Figure.

A further embodiment of the invention is illustrated in FIGS. 15 to 17.

FIGS. 15 to 17 show a handle consisting of lower and upper haft members 310 and 312 respectively, with a slot 314 in the upper haft member, in which slot a trigger button 316 is guided. The portion of the button inside the handle positively encloses a tilting or quick-action nut 318 which is held in a position in which it is engaged with the spindle 322 by a leaf spring 320, provided that the button is not depressed (FIG. 17).

Connection to the ends 324 of a tensioning band is effected by means of a sliding block 326. This block is a punched and bent part made of sheet metal guided so that it can move freely in the upper and lower haft members 312 and 310. This sliding block, to which the ends of the tensioning band are spot-welded, for example, has two cranked slots 328 near to the ends of which a transverse pin 330 passes through the nut and through the corresponding portions of the sliding block; the pin preferably being firmly joined to the nut. Since the pin is arranged on the side of the threaded rod remote from the leaf spring 320 and a short distance behind the upper threads 332 of the nut, when a pull is exerted on the ends of the tensioning band as the band is being tightened by turning the spindle, a torque is transferred to the nut which pulls it into the position, shown in FIG. 15, in which the nut is engaged with the spindle. On the other hand, pressing the trigger button 316 disengages the threads as shown in FIG. 17.

It will be seen that all parts have been formed in an extremely simple manner, and can be manufactured and assembled at low cost, the button 316 being manufactured preferably as an injection moulded or moulded part of plastics material.

FIGS. 18 to 20 show the special shaping of a stop 340 of soft polymeric material. When the lid of a container has little depth, tabs 342 of the stop 340 are positioned on the upper side of the lid, as shown, whereas if the lid has greater depth these tabs simply bend upwards. With lids of very small diameter (FIG. 20) a middle section 344 of the stop is compressed into a recess 346 in the upper and lower haft members 312 and 310, whereas when the lids are relatively large the stop is supported by means of the prongs 348 of the hafts on the outer arms 350.

What we claim is:

1. A device for opening a screw cap on a container, the device comprising:

a handle, a band of material mounted by the handle so as to project therefrom in a loop to embrace such a screw cap, tensioning means connected with the band and comprising two co-operating screw-threaded members on the handle and manually operable to tighten the band about the screw cap to be opened by contracting the size of the loop, and adjustment means on the handle and manually operative to act upon and disengage the band tensioning means and provide a substantially coarser adjustment of the size of the loop than that provided by the band tensioning means.

2. A device as claimed in claim 1, wherein the two co-operating screw-threaded members include a first screw-threaded member rotatably mounted and also includes a second screw threaded member slidably but non-rotatably mounted, at least one end of the band is connected for movement with the second screw-threaded member, the second screw-threaded member is so constructed that its thread can be disengaged from the thread of the said first screw-threaded member to allow the said second screw-threaded member to be slid axially along the first screw-threaded member, and the adjustment means is operative to disengage the threads of the said screw-threaded members.

3. A device as claimed in claim 2, wherein the first and secnd co-operating screw-threaded members comprise a rotatably mounted rod and a slidably but non-rotatably mounted nut, respectively, at least one end of the band is connected for movement with the nut, and the adjustment means comprises a slidably-mounted member manually operable to disengage the threads and slide the nut along the rod.

4. A device as claimed in claim 3, wherein the nut has two bores intersecting at an angle, one of these bores being a threaded bore, and the other having a diameter which is lager than the diameter of threads of the rod, and the slidably-mounted member is operative to tilt the nut.

5. A device as claimed in claim 3, wherein a retainer member is slidably mounted inside the handle and is adjacent the slidably-mounted member, and the retainer member contains the nut, and resilient restoring elements on the retainer member and bearing against the nut in the longitudinal direction of the handle.

6. A device as claimed in claim 3, wherein the handle has a longitudinal slot parallel to the rod, the slidably-mounted member comprises a ring member about the outside of the handle, and means projecting through the slot in the handle and providing an operative connection between the nut and the ring member to disengage the threads of the nut from the threaded rod.

7. A device as claimed in claim 4, wherein a retainer member is slidably mounted inside the handle adjacent the slidably mounted member, the retainer member embracing the nut and slidably receiving the rod therethrough, the nut having one end with an end face lying at right angles to the threaded bore, a compressible cup spring on the retainer member and confronting the end face of the nut and a resilient restoring element on the retainer member and urging the nut toward the cup spring for returning the end face of the nut against the cup spring.

8. A device as claimed in claim 7, wherein a ring member embraces the handle and is connected to the retainer member for movement therewith, the ring member having a disengaging element by means of which the plane end face of the nut may be moved away from the cup spring to tilt the nut.

9. A device as claimed in claim 8, wherein the disengaging element is a wedge-shaped portion on the ring member and projecting through a slot in the handle to move the nut.

10. A device as claimed in claim 4, wherein rocker arms are attached to the nut and project through at least one slot to the outside of the handle, a moment tilting the nut being applicable manually to the said arms.

11. A device as claimed in claim 6, wherein the nut has a rocker arm projecting outwardly transversely to the threaded bore, the ring member has stops which can be brought into operative connection with the ends of the rocker arm to tilt the nut.

12. A device as claimed in claim 4, wherein the ends of the band are directly attached to the nut at one side in such a manner that the reaction force transferred to the nut when tightening the band acts as to engage the threads.

13. A device as claimed in claim 4, wherein both ends of the band are joined to a sliding element guided so that it can slide inside the handle, to which sliding element the nut is connected by means of a pin extending transversely to the direction of a displacement, a sliding grip affixed to the nut and pivotable about the pin with the nut so that the nut disengages from the rod, a leaf spring on the sliding element on the side of the rod remote from the pin and bearing against the nut to tilt the nut into operative threaded engagement with the threads of the rod, and the pin is arranged relative to the threads of the nut at a point from which a moment tending to cause the threads to engage is transferred to the nut when the ends of the band are pulled by the sliding element.

14. A device as claimed in claim 1, wherein the end of the handle facing, in use, a container to be opened has a central recess and terminates in two short prongs and adjacent to both prongs, bridging the recess, there lies a stop of soft polymeric material on the edge of which aligned with the edge of the handle uppermost in use there are formed tabs to face said container.

* * * * *